United States Patent [19]

Chu

[11] Patent Number: 4,890,008

[45] Date of Patent: Dec. 26, 1989

[54] MULTI-FUNCTION AUTOMATIC REVOLVING CHRISTMAS TREE BASE

[76] Inventor: Ven-Chung Chu, 3F, N.3, Lane 42, Yu Hsi Street, Yung Ho, Taipei, Taiwan

[21] Appl. No.: 921,698

[22] Filed: Oct. 22, 1986

[51] Int. Cl.[4] ..... A47G 33/12

[52] U.S. Cl. ..... 307/149; 307/147; 248/522; 248/521; 108/20; 108/21

[58] Field of Search ..... 307/149, 147; 315/185 R, 185 S; 464/163; 108/20, 21, 22; 248/522, 349, 519, 521, 523, 524, 527, 529; 74/425, 425.5, 640, 426, 89.14, 724; 47/40.5

[56] References Cited

U.S. PATENT DOCUMENTS

| | | | |
|---|---|---|---|
| 333,617 | 1/1886 | Eckardt | 248/522 |
| 1,028,670 | 6/1912 | Hubbard | 108/20 |
| 1,143,279 | 6/1915 | Johnson | 108/20 |
| 1,263,211 | 4/1918 | Conrad | 108/20 X |
| 1,435,856 | 11/1922 | Kelly | 108/20 X |
| 1,468,247 | 9/1923 | Patten | 108/21 |
| 1,527,596 | 2/1925 | MacCartney | 248/349 X |
| 1,656,527 | 1/1928 | Messinger et al. | 108/20 X |
| 1,699,463 | 1/1929 | Cresci | 248/349 X |
| 1,943,659 | 1/1934 | Eason | 47/40.5 |
| 1,971,300 | 8/1934 | Garrett | 248/522 |
| 1,988,343 | 1/1935 | Tacy | 248/522 |
| 2,005,293 | 6/1935 | Harris et al. | 248/522 |
| 2,058,677 | 10/1936 | Fritz | 47/40.5 |
| 2,279,182 | 4/1942 | Snyder | 248/521 X |
| 2,469,884 | 5/1949 | Masone | 248/521 |
| 2,485,460 | 10/1949 | Rocco | 307/157 |
| 2,587,788 | 3/1952 | Tacy | 248/522 |
| 2,847,175 | 8/1958 | Farley et al. | 248/522 X |
| 2,956,356 | 10/1960 | Rakes | 248/349 |
| 3,042,350 | 7/1962 | Lencioni | 248/522 X |
| 4,061,306 | 12/1977 | Taylor | 248/523 |

*Primary Examiner*—William M. Shoop, Jr.
*Assistant Examiner*—Paul Ip
*Attorney, Agent, or Firm*—Staas & Halsey

[57] ABSTRACT

This invention relates to a type of multi-function automatic revolving Christmas tree base. Its rotation directions can be changed automatically by means of a DC motor transmission to drive the revolving cylinder of the Christmas tree, which drives a two-way exchanging mechanism to change the polarities of the input current from the DC motor, so that the DC motor can rotate in positive and reverse directions. On the outer walls of the revolving cylinder are two conductive copper collars in connection with outer power source. Part of the two conductive copper collars is extending upwards through the wall of the revolving cylinder and in connection with another socket, which can serve as the power source of the lamps on the Christmas tree. Therefore, when Christmas tree is turning in one direction, there is no worry of the winding and knotting of the power cords.

3 Claims, 10 Drawing Sheets

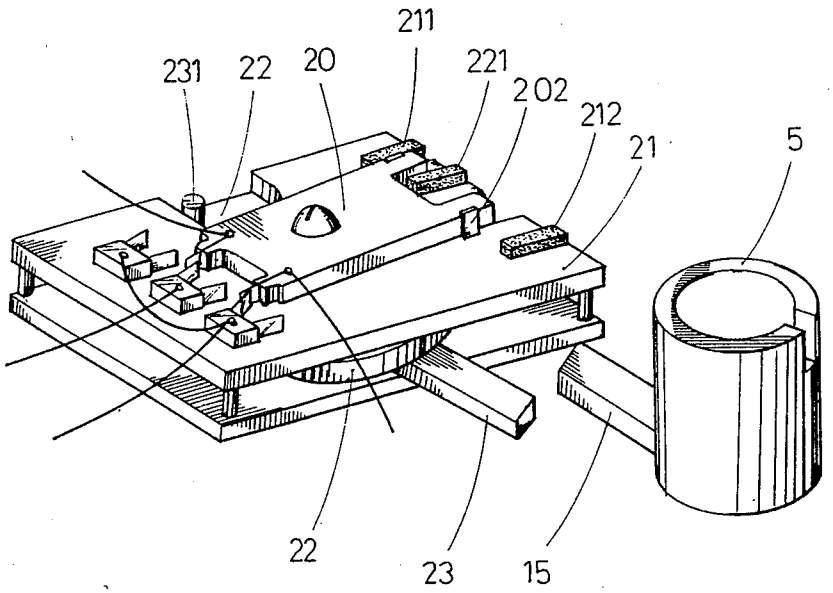
FIG 3.1

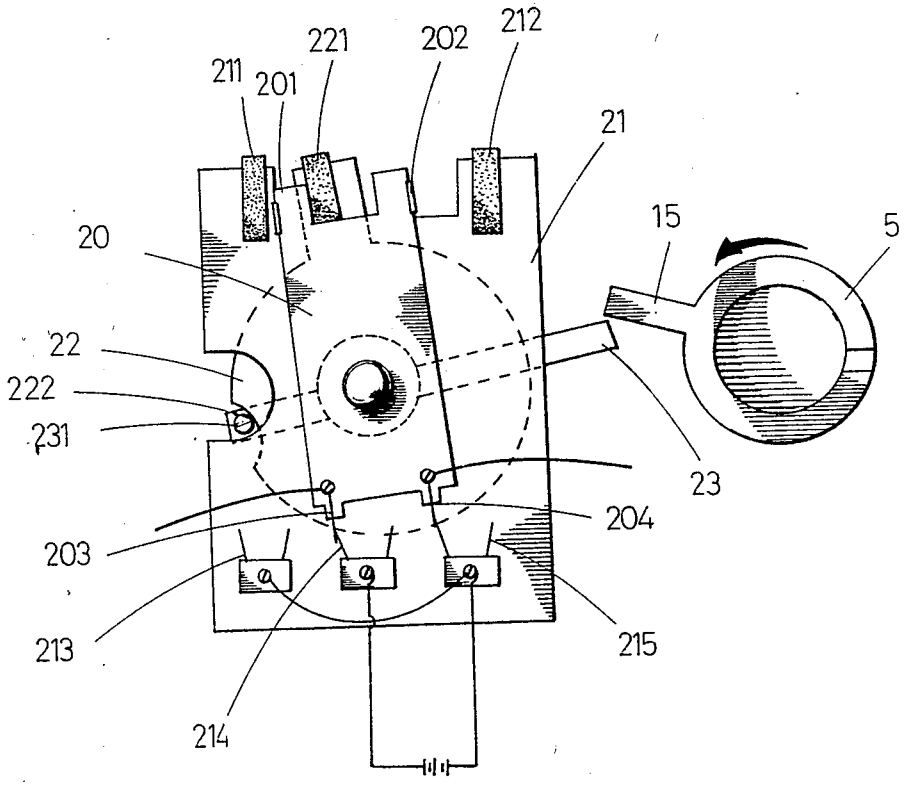
FIG. 3·2

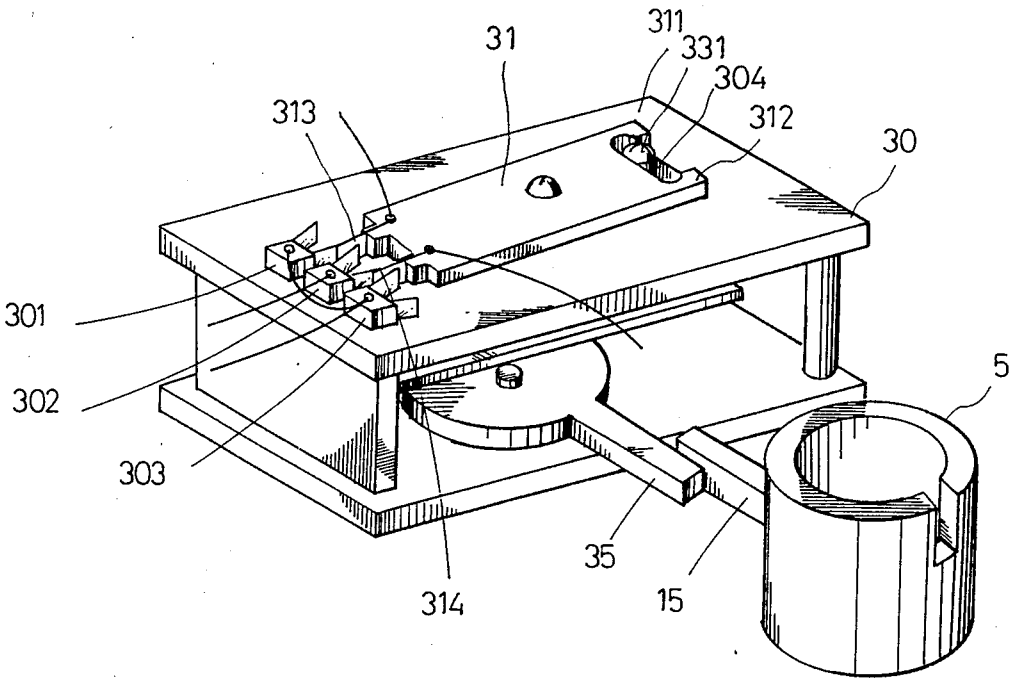
FIG. 4.1

MULTI-FUNCTION AUTOMATIC REVOLVING CHRISTMAS TREE BASE

BACKGROUND OF THE INVENTION

Traditional Christmas trees are inserted in a base and cannot revolve or turn. Flashing of lamps alone is monotonous and lacks the effect of animation. This item has been invented by the inventor based on his many years experience. This base serves to provide an multi-function automatic rotation-changing Christmas tree base, so that the Christmas tree can keep changing the rotation direction by means of the driving mechanism and two-way exchanging unit to increase the special effects of animation. Another purpose of this invention is to install two conductive copper collars on the revolving cylinder to connect the Christmas tree lamps to the outside power source, and to avoid winding and knotting the power cords together when the Christmas tree is turning in a single direction.

SUMMARY OF THE INVENTION

This invention refers to a multi-function automatic rotation-changing base for a Christmas tree, especially a base equipped with two-way exchanger mechanism. A revolving cylinder driven by a DC motor is fitted on the base. The rotation of the revolving cylinder by means of a driving guide rod at the side wall activates the two-way exchange mechanism changes the polarities of the input current from the DC motor and to change the direction of rotation of the revolving cylinder, so that when the Christmas tree is inserted inside the revolving cylinder, it will revolve according for special effects.

DETAILED DESCRIPTION OF THE INVENTION

Figure 1:
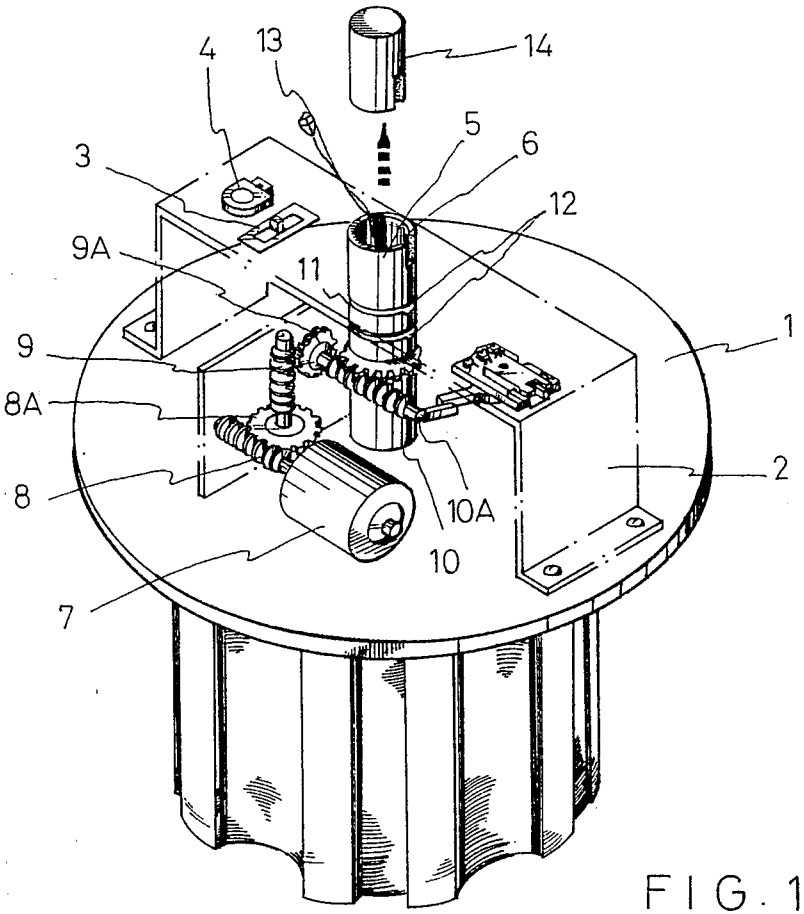
FIG. 1 shows the appearance and construction of the invention.
Figure 2:
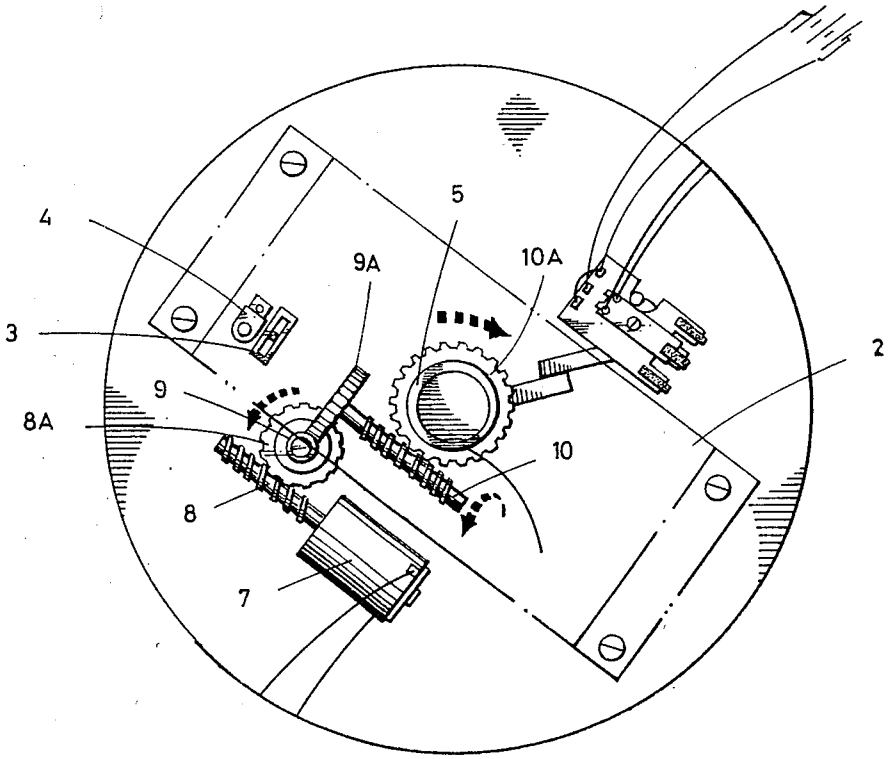
FIG. 2 shows the transmission of the invention.
Figure 3:
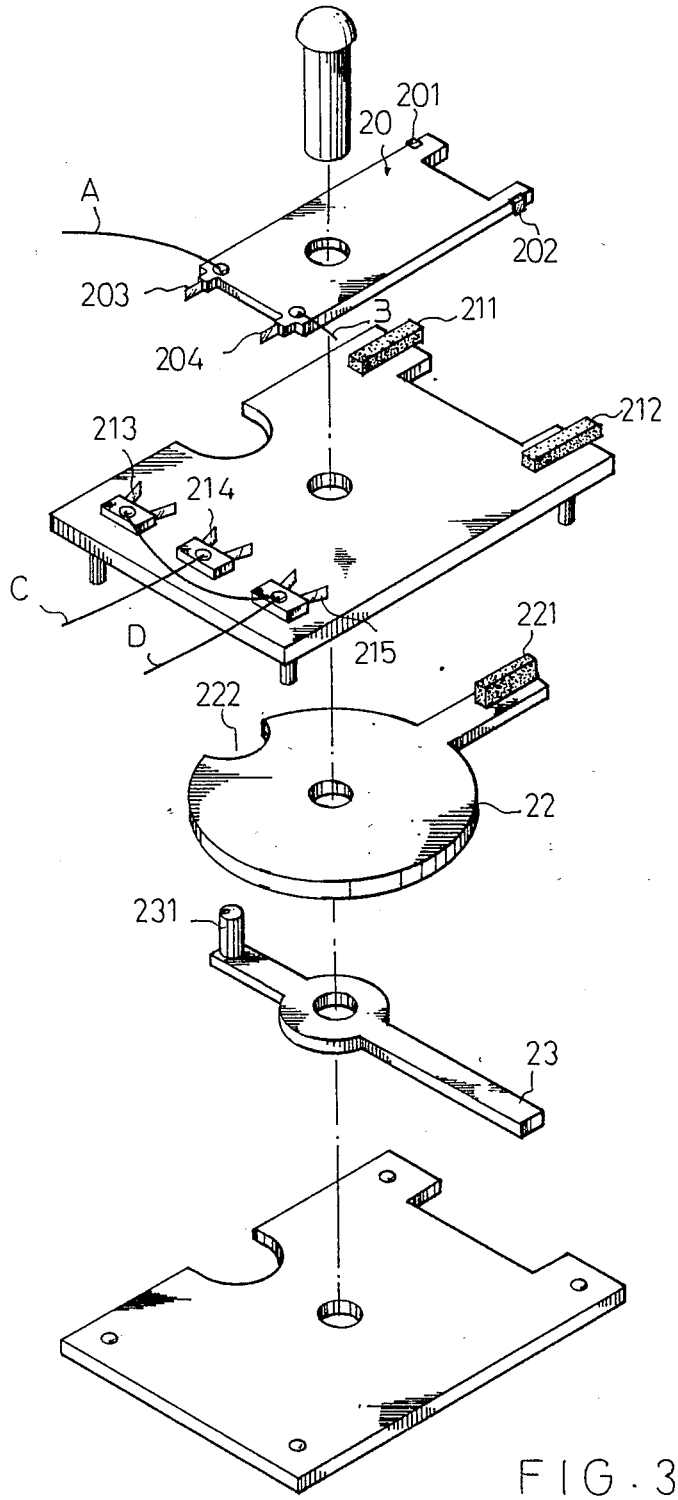
FIGS. 3.1–3.3 show the construction of the two-way exchanging mechanism of the invention.

FIGS. 1 and 2 show that the driving mechanism of this invention is installed between the base plate (1) and the bridge (2) in the shape od a reversed "U", with two ends fixed on the edge of the base plate (1), its top is fitted with a central hole for the outer connection with the power input hole (4) and the power selection switch (3), while the round revolving cylinder (5) is inserted in the central hole of the bridge (2) and protrudes from the bridge (2), on the top of the protruding wall is a slot (6). The above mentioned driving mechanism (as shown in FIG. 2) is composed of a DC motor (7) and three sets of worm, worm gear speed reducer gear assembly, in which the first worm (8) is installed on the output driving shaft of DC motor (7). While the first worm gear (8A) is toothed with the worm (8), the second worm (9) is installed on the driving shaft of the worm gear (8A) and toothed with the second worm gear (9A), and the driving shaft of the second worm gear (9A) is fitted with a third worm (10) which is on the wall of the revolving cylinder (5) below the bridge (2) and toothed with the worm gear (10A). When the speed of the second worm (9), second worm gear (9A), the third worm (10) and worm gear (10A) is reduced for transmission, it will slow down the rotation of the revolving cylinder (5). FIG. 1 also shows that the outer wall of the revolving cylinder (5) is fitted with the conductive copper collars (11) in connection with the outer power source through two contact pieces (12). The two conductive copper collars (11) extend upwards from the wall of revolving cylinder (5) and connect to a socket (13) along the conductive wire, so there is no worry of the problem of winding or knotting cords together when the Christmas tree is turning in a single direction. In addition, the above mentioned Christmas tree is fixed by the slot (6) and fitted on the top with a protruding block (14) inserted in the revolving cylinder (5). FIGS. 3.1–3.3 show that the two-way exchanging mechanism of this invention is a magnetic activating two-way exchanging mechanism, composed mainly of a power selecting board (20), a motherbord cartridge (21), a magnetic guiding plate (22) and a dependent or driven guide rod (23), etc., in which the power selecting board (20) and the magnetic force guiding plate (22) are separated and located at the upper and lower surfaces of the upper layer of the motherbord cartridge respectively and jointly joined at one point, in which the front end of the power selecting board (20) is fitted with two protruding parts on the left and right; each protruding part is fitted with a small iron piece (201) and (202). At the rear end of the power selecting board (20) are two copper pieces (203) (204) which are connected to the input terminal of the DC motor (7) through the conductive wire. At the front end of the upper layer of the motherboard cartridge (21) are left and right protruding parts each is inserted with one armature (211) and (212), whereas at the rear end of the upper layer of the motherboard cartridge (21) are three sets of U-shaped sopper pieces (213), (214) and (215), in which the right and left U-shaped copper pieces (213) and (215) are in connection with each other whereas with one pole of the battery, and the middle U-shaped copper piece (214) is in connection with the other polarity of the battery. On top of the magnetic guiding plate (22) is a protruding block inserted with other armature (221) and located between the two protruding parts of the two ammatures (211) and (212) at two sides of the motherboard cartridge (21) and the power selecting plate (20), while one end of the magnetic force guiding plate (22) is fitted with a semi-circle opening (222). The dependent or driven guiding rod (23) is jointed on the lower surface of the motherboard cartridge (21) with one end fitted with the round protruding post (231) and inserted in the semi-circle opening (222) corresponding to the said magnetic force guiding plate (22), while the other end of the dependent or driven guide rod (23) is located beside the revolving cylinder (5). Because the armature (221) on top of the magnetic force guiding plate (22) will approach one of the two armatures (211) and (212) on top of the motherboard cartridge (21) due to the magnetic attraction, as illustrated in FIGS. 3.1–3.3, the armature (221) will approach the armature (211), so the protruding block in front of the magnetic force guiding plate (22) will push the power selecting board (20) to the left side and fix its position by attracting the small iron piece (201) and armature (211) at the protruding part in front of the power selecting board (20); then the copper piece (203) in the rear end of the power selecting board (20) will move to the right and contact the U-shaped copper piece (214) at the middle of the upper layer of the motherboard cartridge (21); meanwhile the copper piece (204) will also move to the right and contact the copper piece (215). At this time, one end of the dependent or driven guide rod (23) is nearer to the front end of the motherboard cartridge (21), and the DC motor (7) will turn in counter-clockwise direction by the transmission of the revolving cylinder (5). When the driving guiding rod (15) the wall side of the revolving cylinder (5) contact the driven guide rod (23) and push the rear end of the motherboard cartridge (21). It will drive the magnetic force guiding plate (22) to the right, before the front armature (221) turns to its middle point, the small iron piece (201) in front of the power selecting board (20) is still in contact with the armature (211), so the corresponding positions are not changed. After the armature (221) in front of the magnetic force guiding plate (22) passes its middle point, the power selecting board (20) will be pushed to the right causing the separation of the copper piece (203) and (204) from the U-shaped copper pieces (214) and (215), respectively; therefore, the DC Motor (7) and the driven revolving cylinder (5), the driving guiding rod (15) and the driven guide rod (23) will temporarily stop. However, the passing of armature (221) over its middle point will cause the armature (221) to be attracted immediately to the armature (212) and push the power selecting board (20) to the right and cause the copper pieces (203) and (204) in contact with the U-shaped copper pieces (213) and (214) respectively. At this moment, the polariries of the input end of the DC motor (7) will be exchanged, so that the revolving cylinder (5) changes its rotation to the counter-clockwise directions. Therefore, each time when the revolving cylinder (5) turns to the driving guide rod (15), it will be pushed by the driven guide rod (23) and will change its rotation, so the revolving cylinder (5) can keep changing its rotation direction.

Figures 2, 4:
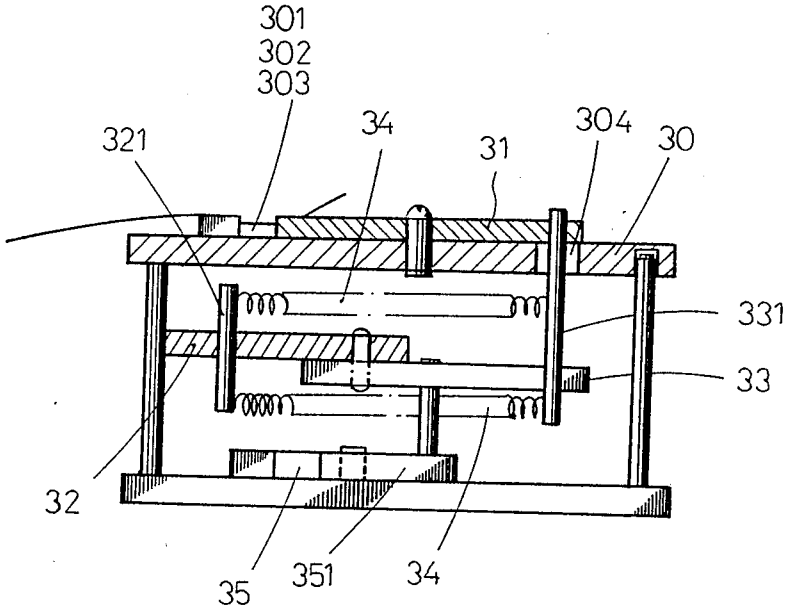
FIGS. 4.1–4.4 show another construction view of the two-way exchanging mechanism.
Figures 3, 4:
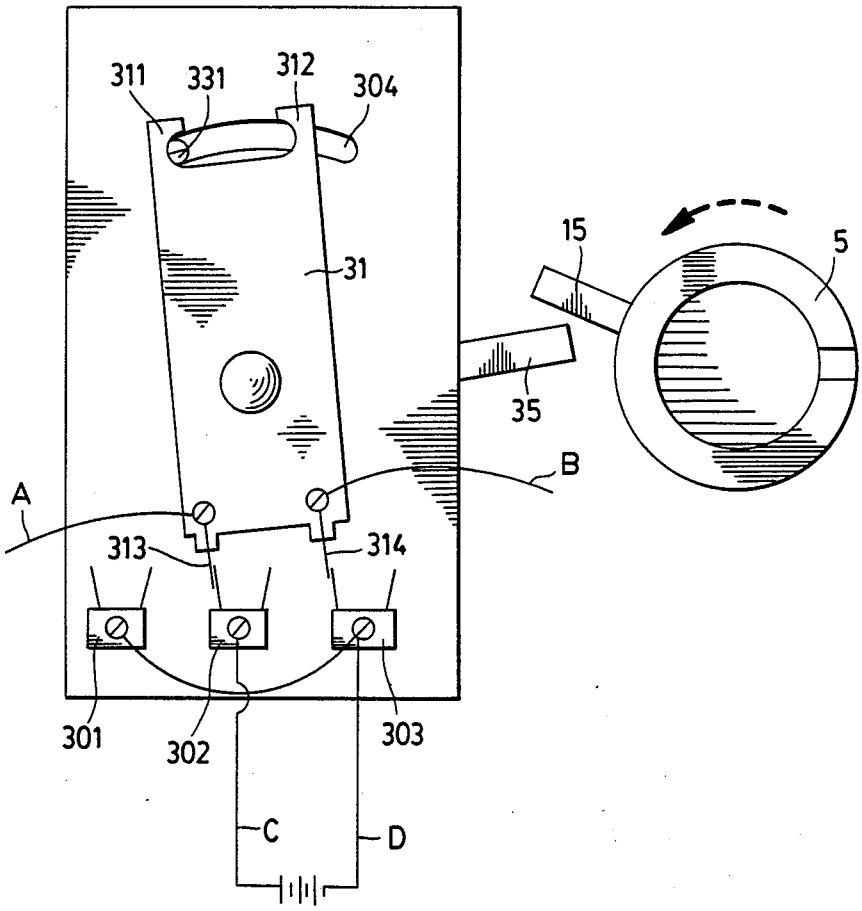
Figure 4:
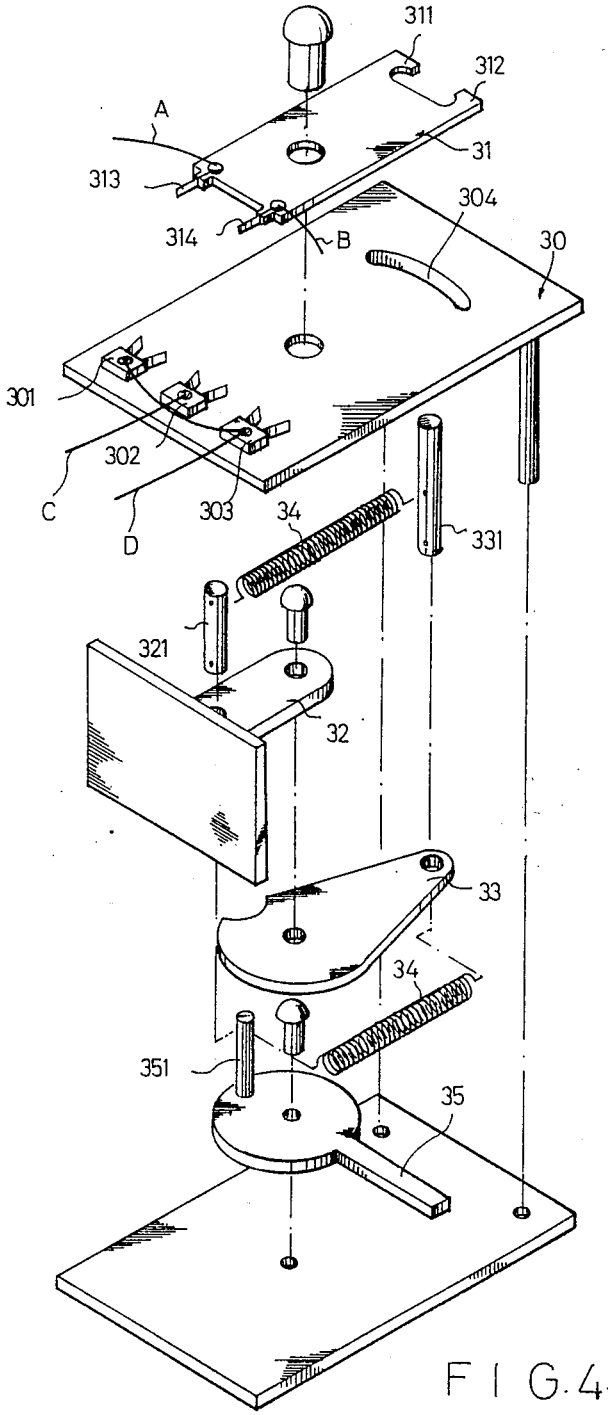

The two-way excnanging mechanism of this invention can also be of the spring type as illustrated in FIGS. 4.1–4.4 with the same functions. The cartridge body (30) is a rectangulat box structure. The power selecting board (31) is jointed on the upper layer of the cartridge body (30). In the front end of power selecting board (30) are two protruding parts (311) and (312), whereas at its rear end are fitted with with copper pieces (313) and (314) connected with the two input terminals of the DC motor (7), respectively. The rear upper layer of cartridge body (30) are fitted with three sets of U-shaped copper pieces (301), (302) and (303), with the left and the right U-shaped copper pieces (301) and (303) in connection with one polarity of the battery, and the middle U-shaped copper piece (302) in connection with the other polarity of the battery. Inside the cartridge body (30) is a level partition (32); its rear is fitted and intersecting with a fixing rod (321) which is fixed. The guiding plate (33) is joined with the lower center of the level partition (32); its front is pierced with a moving rod (331) which is also fixed. The top of the moving rod (331) passes through the slot (304) at the upper layer of the cartridge body (30) and can be in contact with the two protruding parts (311) and (312) at the front of the power selecting board (31). Between the moving rod (331) and the fixing rod (321) is the connection of two springs (34). The driven guide rod (35) is fixed and joined at the lower layer of the cartridge body (30), with one end protruding post (351) in contact with the semi-circle opening (332) of the guiding plate (33). Therefore, when the driven guide rod (35) is pushed by the driving guide rod (15) on the revolving cylinder (5), it will move to one side through the protruding post (351) driving the power selecting board (31). Its relevant mechanism is the same as that of the magnetic exchanging mechanism, so when the two copper pieces (313) and (314) at the rear of the power selecting board (31) and the three sets of U-shaped copper pieces (301), (302) and (303) at the rear end of the upper layer of cartridge body (30) so change their corresponding positions, so the polarities of the DC motor (7) will be changed automatically to reverse the rotation direction.

Figure 5:
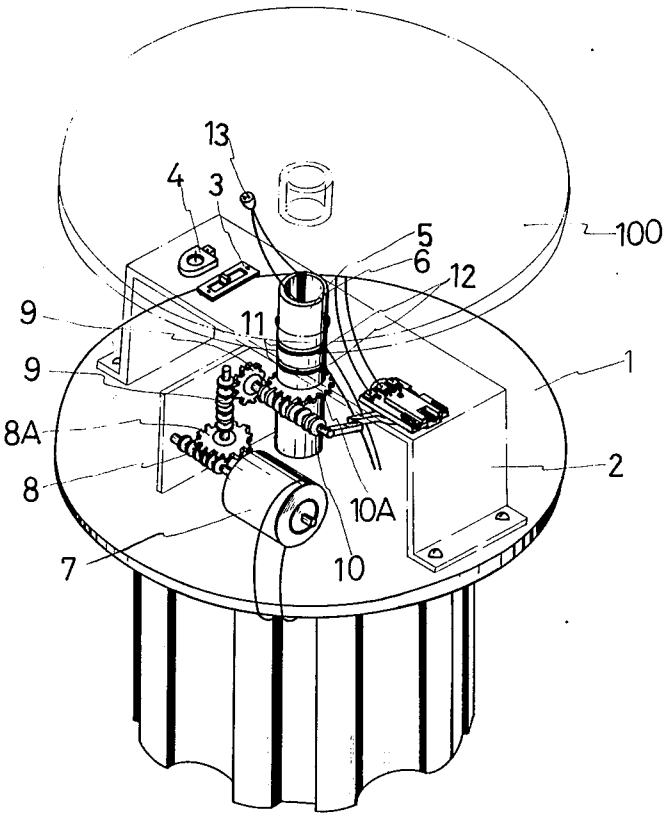
FIG. 5 shows the construction of revolving cylinder add a revolving-tray of the invention.

Besides, as FIG. 5 shows that a revolving tray (100) is equipped on the top of the outer rim; it can keep changing the rotation directions. All kinds of ornaments can be put on the revolving tray (100); this will achieve the effect of ornaments to the Christmas tree, the greatest merit is to be able to put the Christmas tree on the revolving tray (100). Since it can change the directions of rotation, it is no worry of the winding and knotting of the power cords, and this achieves the effect of using a real or artificial Christmas tree. Moreover, this invention is not only for the use of a Christmas tree base but also for the use of the double-revolving base of toy or lamp's ornaments; it has multi-function usage; This is actually a muti-function invention. In conclusion, this invention achieves the purpose of changing its rotation directions by means of the two-way exchanging mechanism and the changing direction of the DC motor to increase its animation; meanwhile, without the use of two-way exchanging mechanism, the Christmas tree can turn in a single direction without the problem of winding or knotting power cords. It is indeed an innovative and practical invention.

I claim:

1. A rotation-changing Christmas tree base, comprising:

a base;

a bridge secured at said base;

a revolving cylinder mounted at said base;

a driving mechanism between said base and said bridge for actuation of said revolving cylinder;

a two-way exchanging mechanism operatively connected to said revolving cylinder;

wherein said bridge is of inverted "U" shape with each one of the two ends of said bridge being fixed near the edge of said base, said bridge having a central round hole and peripheral power-cord input holes;

at least one power selection switch secured at said bridge;

said revolving cylinder being located at the centre of said base, with the top end of said revolving cylinder penetrating through said central round hole of said bridge, and the top end of said revolving cylinder having a slot formation;

at least two conductive copper collars arranged at the outer wall of said revolving cylinder, with part of each collar being embedded in the wall of said revolving cylinder, and with part of each collar extending upwards for connection with a socket;

said socket connected with conductive wires to said collars;

a driving guide rod connected at the outer wall of said revolving cylinder;

said driving mechanism located between said bridge and said base including a DC motor adapted to drive said revolving cylinder, and including three sets of toothed worm gears and associated worm speed reducer gearing.

2. The two-way exchanging mechanism of claim 1 comprising:

a power selecting board;

a motherboard cartridge operatively connected at said power selecting board a magnetic-force guiding plate operatively connected at said motherboard cartridge, said magnetic-force guiding plate having in one side a round formation for a respective protruding post;

a driven guide rod adapted to operatively engage said driving guide rod of said revolving cylinder, with said power selecting board and said magnetic-force guiding plate being arranged separately at the upper and lower layers of said motherboard cartridge, respectively, but joined at one point; said driving guide rod joined and fixed at the lower layer of said motherboard cartridge;

two protruding parts at the forward end of said power selecting board;

for each protruding part of said power selecting board a small iron piece secured thereto;

two copper pieces secured at the rear end of said power selecting board and adapted to be connected to an input terminal of said DC motor by means of an electric cable;

two protruding parts at the upper forward end of said motherboard cartridge;

for each protruding part of said motherboard cartridge at least one respective armature;

a set of three U-shaped copper pieces secured on the rear upper layer of said motherboard cartridge, with the respectively outer U-shaped copper pieces being connected to one another, and at least one is connected to one pole of a respective battery, and the respective central in the set of three U-shaped copper pieces is connected to the other pole of the respective battery;

a battery operatively connected at the respective U-shaped copper pieces;

two copper pieces operatively secured at the rearward end of said power selecting board to be located between respective pairs of the set of three U-shaped copper pieces at the rearward end of said motherboard cartridge;

at the forward end of said magnetic-force guiding plate, a protruding part which is situated between said two protruding parts of said power selecting board and said motherboard cartridge;

an armature secured at said protruding part of said magnetic-force guiding plate;

a protruding post secured at one end of said driven guide rod, said protruding post being adapted to operatively engage said magnetic-force guiding plate at the round formation thereof; and wherein the other end of said driven guide rod is located adjacent said revolving cylinder, but adapted to be pushed by said driving guide rod towards said revolving cylinder.

3. The two-way exchanging mechanism according to claim 1, which is essentially of spring construction, and comprising:

a cartridge of substantially rectangular box structure, its front upper layer having at leaast one slot formation and at the rearward end there is provided a set of three U-shaped copper pieces; the respective left and right U-shaped copper pieces are connected to one another and to a first pole of the respective battery, while the central U-shaped copper piece is connected to the other pole of the respective battery;

a power selecting board fixed onto the upper layer of said cartridge, said power selecting board having at its front two protruding parts and two copper pieces at its rear, with said two copper pieces respectivelly being connected to the input terminals of said DC motor by means of conductive wires, said two copper pieces being located between the U-shaped copper pieces at the rear of said upper layer of said cartridge;

a level partition inside said cartridge, said level partition having a through hole at its rearward end through which can extend a respective fixing rod;

a fixing rod secured in said through hole of said level partition;

a guiding plate secured at the centre of said level partition, with the forward end of said guiding plate comprising a protruding part, and said guiding plate having a round formation in one side;

a moving rod secured at the forward end of said guiding plate, with the top of said moving rod extending through said slot formation at the front upper layer of said cartridge, to be located between said two protruding parts at the front of said power selecting board;

an upper spring and a lower spring respectively disposed between said moving rod of said guiding plate and said fixing rod of said level partition;

a driven guide rod jointed and fixed on the lower layer of said cartridge, with one end of said driven guide rod being fitted with a respective protruding post;

a protruding post secured at said driven guide rod and adapted to engage said round formation at the side of said guide plate; and with the other end of said driven guide rod being located adjacent said revolving cylinder for being actuated by said driving guide rod of said revolving cylinder.

* * * * *